United States Patent [19]

Stevens

[11] 4,289,442

[45] Sep. 15, 1981

[54] BOOM LIFT LOAD RELIEF

[76] Inventor: James L. Stevens, 14825 Arkansas St., Woodbridge, Va. 22191

[21] Appl. No.: 88,743

[22] Filed: Oct. 26, 1979

[51] Int. Cl.[3] ..... B66F 9/10

[52] U.S. Cl. ..... 414/629; 414/631; 414/785

[58] Field of Search ..... 414/785, 629, 631

[56] References Cited

U.S. PATENT DOCUMENTS

| | | | |
|---|---|---|---|
| 2,320,601 | 6/1943 | Howell | 414/631 |
| 2,754,020 | 7/1956 | Dunn | 414/631 X |
| 3,232,465 | 2/1966 | Romine | 414/785 X |
| 3,982,646 | 9/1976 | Gaskin | 414/631 |
| 4,027,771 | 6/1977 | Adams | 414/785 |

*Primary Examiner*—Richard A. Schacher

*Attorney, Agent, or Firm*—Peter A. Taucher; John E. McRae; Nathan Edelberg

[57] ABSTRACT

In a cargo-transfer system wherein a truck-mounted boom is extendable into a cargo space to manipulate a cargo-lift mechanism, the improvement comprising a lowerable roller mechanism carried by the lift mechanism to slightly elevate the mechanism from the cargo space floor, thereby transferring the cargo weight to the floor, thus relieving the load that would otherwise have to be carried by the outboard end of the boom. The invention permits greater cargo weights and/or a greater extension of the boom, and/or a lighter and cheaper boom, and/or a lower cost power system.

2 Claims, 10 Drawing Figures

8
10
12
14
16
18
20
22
24
26
28
30
32
33
34
36
38
40
42
43
44
46
47
48
49
50
52
54
56
60
62
64
66
68

BOOM LIFT LOAD RELIEF

The invention described herein may be manufactured, used, and licensed by or for the Government for governmental purposes without payment to me of any royalty thereon.

BACKGROUND AND SUMMARY OF THE INVENTION

It is conventional practice to strap cargo onto pallets and to transfer the loaded pallets to or from storage vans or trailers by the use of forklift trucks. Wherever possible the forklift trucks are driven directly into the van to remove or deposit the loaded pallets from/on the floor of the van. However, where there are no loading docks or ramps it is usually not possible to drive the forklift truck into the van. In such instances it is often necesssary to use a truck equipped with an extendable boom that is mounted in cantilever fashion at the rear end of the truck; the boom carries a cargo-lift mechanism at its outboard or forward end. In use of the apparatus the truck is driven as close as possible to the rear end of the van so that the boom projects into the van interior. The forwardly-facing driver observes the position of the lift mechanism relative to the cargo, and accordingly operates suitable controls to raise or lower the boom for lifting or lowering palleted cargo. By extending or retracting the boom in the direction of its length the driver can transfer the cargo lengthwise of the van without relocating the truck.

In use of this boom-equipped truck a mechanical overloading problem exists because of the relatively great length of the boom and the location of the cargo-lift mechanism at the extreme outboard end of the boom. The boom is often comprised of a series of telescoped cylinder-piston assemblies of progressively decreasing diameter measured from the mounted end of the boom; hydraulic pressure is used to extend or retract the piston-cylinder assemblies. When relatively heavy cargo is being handled the boom sometimes has difficulty in raising the cargo from the van floor. Bending forces on the boom tend to produce a binding action between the piston and cylinder surfaces, thereby increasing hydraulic pressure requirements.

A principal aim of the present invention is to provide the cargo-lift mechanism with a lowerable roller mechanism that can forcibly engage the floor of the van to slightly elevate the cargo above the floor surface. The weight of the cargo is transferred from the outboard end of the boom to the floor of the van, whereby the boom is required only to push or pull the cargo lengthwise of the van, at least until the boom is retracted or shortened sufficiently to locate the cargo near the mounted end of the boom where it can be easily handled without producing an excessive force moment on the boom.

By using the lowerable roller mechanism it should be possible to achieve operating advantages in such respects as longer boom length for use in longer vans, a lighter boom structure, lower hydraulic pressure requirement or hydraulic pump volume requirement, smaller hydraulic reservoir requirement, longer operating life, and/or faster piston motion and consequent reduction in cargo manipulation time.

THE DRAWINGS

Figure 1:
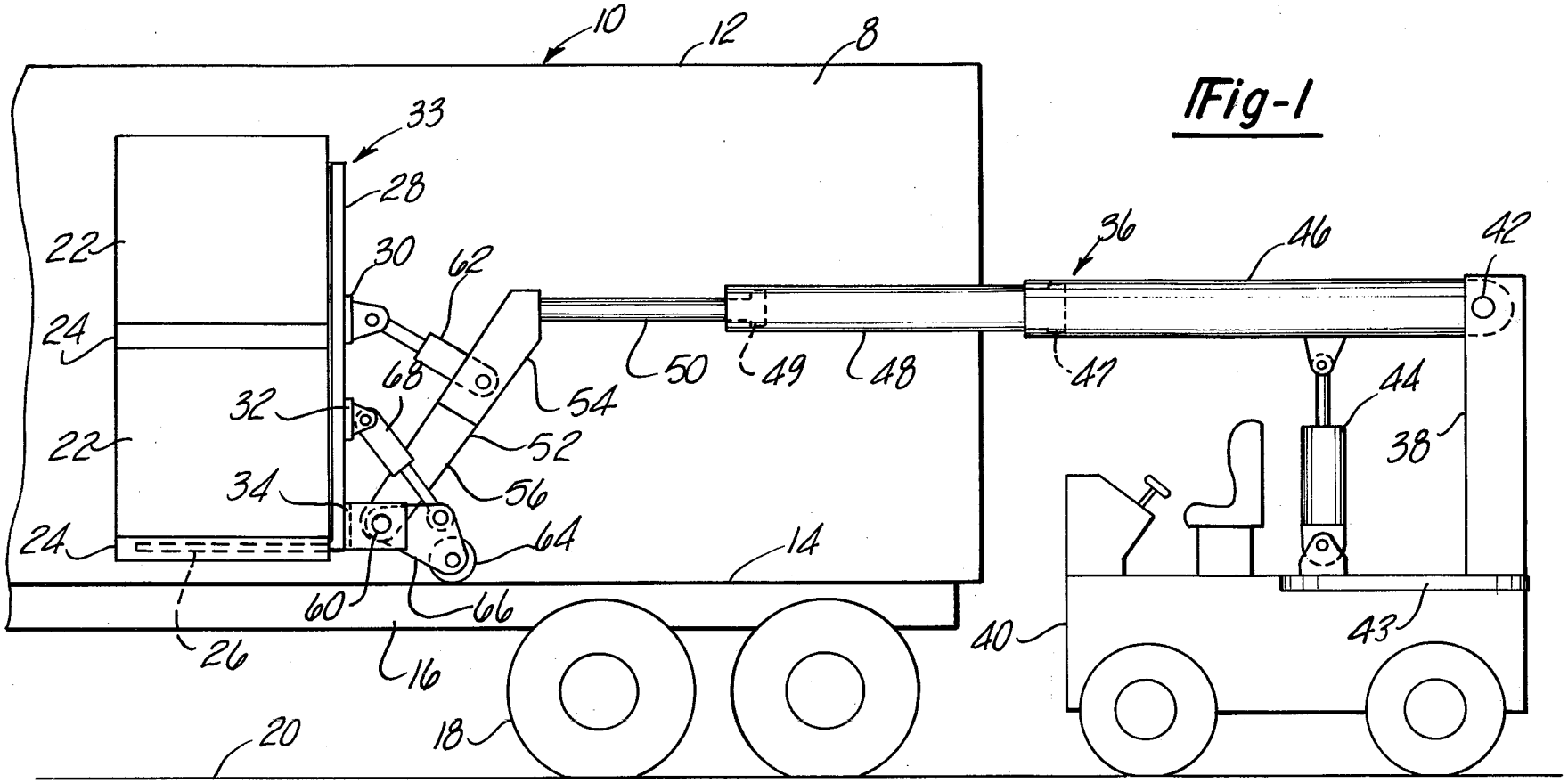
FIG. 1 is a side elevational view of a cargo-transfer system embodying my invention.

Referring more particularly to FIG. 1, there is shown in side elevation the rear end of a cargo space designated by numeral 8. The space may be any long enclosed storage area accessible from one end only, e.g. the right end in FIG. 1. As shown, the cargo storage space is defined by a conventional van or trailer 10 having a roof 12, floor 14, and undercarriage 16 for road wheels 18 that are adapted to roll on ground surface 20. The van can be detachable from the undercarriage, as per the known containerization concept.

The vertical interior space between floor 14 and roof 12 is intended to receive cargo components 22 that have been previously strapped to supporting pallets 24. Each pallet may be about five inches high, sufficient to provide interior space for a pair of lift forks 26, only one of which is visible in FIG. 1. These forks project forwardly from upstanding back or rail structures 28 that are welded or otherwise carried on a carriage defined by three crosspieces 30, 32 and 34. The described cargo-lift mechanism 33 is conventional; it may be formed or reinforced in various ways to withstand expected load conditions.

Lift mechanism 33 is carried on the forward or outboard end of an extensible-retractible boom 36 that is swingably mounted at its rear end on a pedestal 38 carried by motorized truck 40; a pivotal connection 42 provides a cantilever mounting that permits the boom to swing in a vertical plane, as necessary to transfer cargo components 22, 24 between stationary positons on floor 14 of the van and ground surface 20, or other location outside the van. Power for swinging the boom in a vertical plane is provided by a hydraulic cylinder 44 trained between the boom and a subjacent support surface on truck 40. If necessary for quicker manipulation of the cargo, cylinder 44 and pedestal 38 may be supported on a turntable 43 that may for example be rotated in the azimuth plane by a non-illustrated hydraulic motor located within the truck.

Boom 36, as conventionally built, comprises a series of telescoped cylinder-piston assemblies of progressively decreasing diameter measured from the supported rear end of the boom; as illustratively shown the boom comprises a cylinder 46, piston 47, hollow piston rod 48, piston 49, and piston rod 50. Pressurized hydraulic fluid selectively introduced into the opposite ends of elements 46 and 48 produce extension or retraction of the boom 36 sufficient to move the cargo lift mechanism 33 the entire length of storage van 10 without relocating truck 40 from the position shown in FIG. 1. The telescoped piston-cylinder assembly can be reinforced against bending forces by utilizing the piston-cylinder assembly within or on an extensible boom formed of thick-walled tubes or channels, telescoped one within another. In order to simplify the description the reinforcement structure is omitted from the drawings. One usable system is manufactured by Loed Corporation of Wasau, Wisconsin under its designation "552 LOED Handler".

The boom structure may be constructed to have a relatively short or relatively long reach, depending on the dimensions of cargo space 8. For example, boom 36 may have an extended length in excess of twenty-five feet and a much shorter retracted length, e.g. eight feet. Transfer of the cargo between the extreme rear end of the van and ground surface 20 requires that truck 40 be backed away from the van rear end.

Lift mechanism 33 is connected to piston rod 50 by means of an arm structure 52. As illustratively shown in FIGS. 1 and 2, arm structure 52 comprises a channel 54 welded to piston rod 50 and a yoke 56 having downwardly extending arm portions 57 extending alongside two rearwardly-projecting flanges 58 carried by the aforementioned bar 34. A pivot shaft or pin 60 extends laterally through the registering walls to form a pivotal connection between arm 52 and lift mechanism 33. The lift mechanism is also connected to arm 52 via a hydraulic power cylinder 62 having pivotal connections which channel 54 and bar 30. The function of cylinder 62 is conventional, namely to permit the lift mechanism 33 to be tilted either forwardly or rearwardly as necessary, to cradle the load and accommodate different elevational attitudes of boom 36 that may occur during a cargo-transfer operation.

Figure 2:
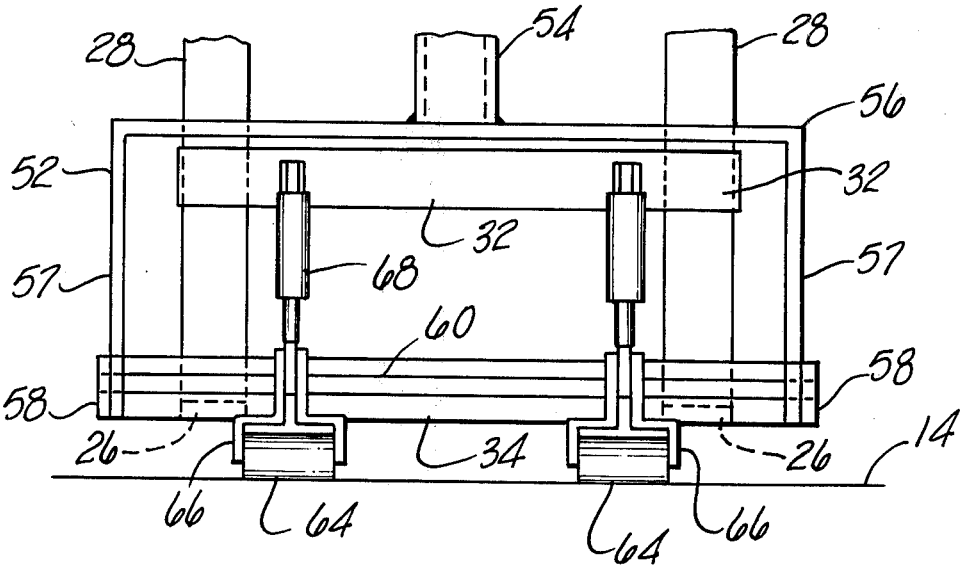
FIG. 2 is an elevational view of a lift mechanism used in the FIG. 1 system.

The mechanism thus far described may be considered conventional. The principal feature of the present invention relates to the lowerable roller means 64 carried by lift mechanism 33 for temporarily transferring the weight of cargo components 22 and 24 onto floor surface 14 when boom 36 is in an extended condition, i.e. when the cargo is near the front end of van 12 remote from truck 40. As shown in FIGS. 1 and 2 there are two rollers 64 individually carried by roller support arms 66 that extend forwardly to pivotal connections with the aforementioned shaft 60. Power for swinging each roller support arm 66 in a vertical arc around the axis of shaft 60 is provided by a hydraulic cylinder 68 having pivtol connections with the respective arm 66 and the previously mentioned bar 32. FIG. 1 illustrates each arm 66 in a position wherein the roller 64 has its lower floor-contacting surface below the lower surface of forks 26 so that the cargo is lifted clear of the floor. In this condition of the mechanism the boom 36 can be extended or retracted to move the cargo toward the front of the van or the rear of the van, as necessary, without any appreciable vertical loading on the boom, as might produce an excessively high force moment on the outboard end 50 of the boom. In order to deposit the cargo components 22 and 24 on floor 14 hydraulic fluid is withdrawn from the upper end of cylinder 68, thereby enabling the weight of the cargo to force the cargo downwardly and arms 66 upwardly.

Each roller 64 is preferably a steel roller having a solid rubber outer surface or facing. Roller diameter is about five inches and roller length is at least about six inches. The length of each roller support arm 66, measured between the swing axis and the roller axis, may be approximately six inches. Motion of each arm to position the roller in its alternate positions is approximately thirty degrees around the shaft 60 axis.

By using the retractable or lowerable roller mechanism shown in FIGS. 1 and 2 it should be possible to obtain various improvements, as for example increased boom length and hence better accommodation to longer vans, less maneuvering requirement for truck 40, a lighter boom structure, and reduced hydraulic flow or pressure requirements. These improvements are realized because the rollers 64 absorb the load of cargo 22 and 24, thus removing that load from the boom so that the boom is subjected to a lesser downward force tending to produce bending or canting of the boom components. The reduced frictional forces between pistons 47, 49 and the cooperating cylinders leads to at least some of the above-enumerated advantages or improvements.

Figure 3:
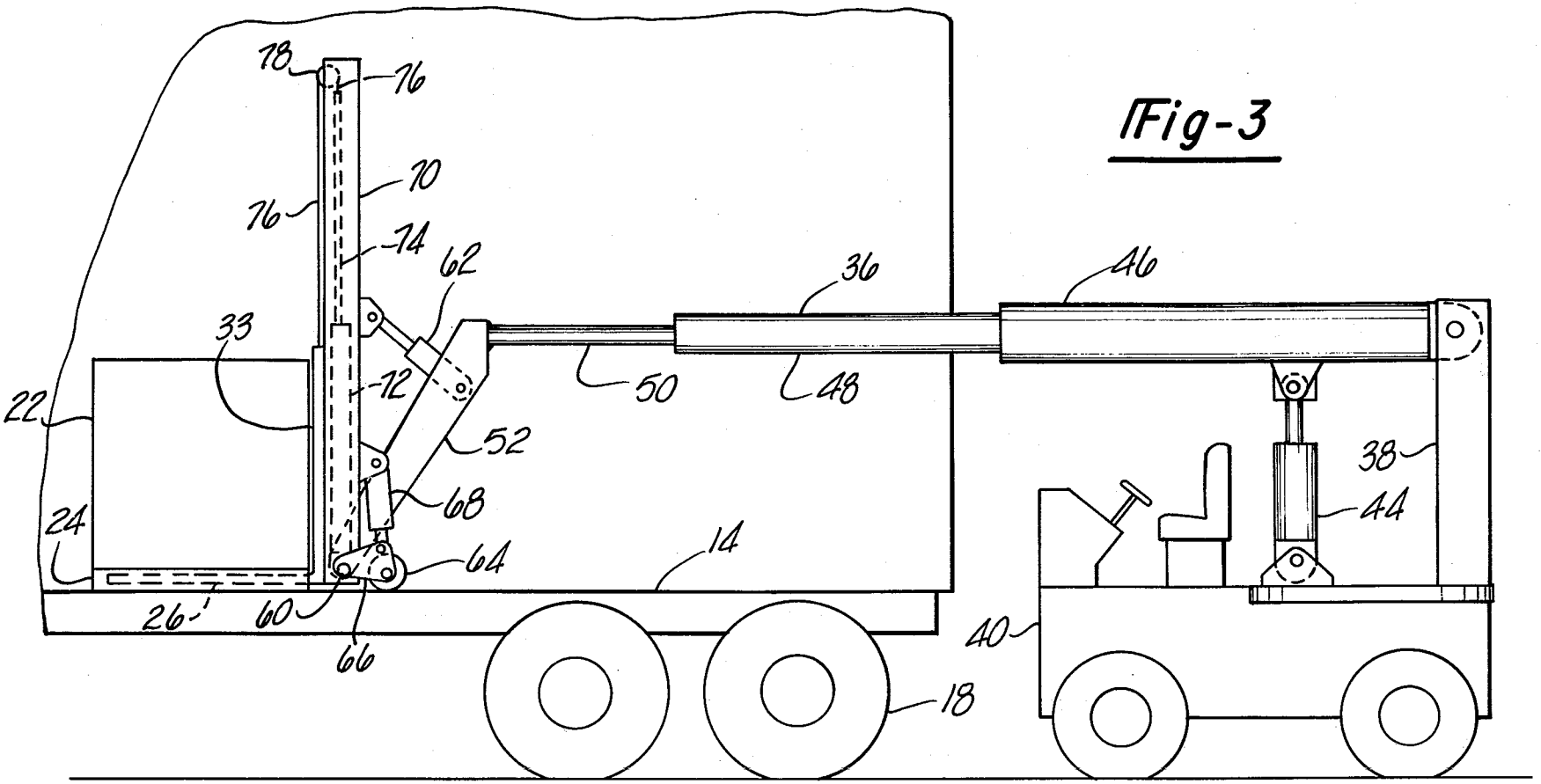
FIG. 3 is a side elevation view of a second cargo-transfer system embodying my invention.
Figure 4:
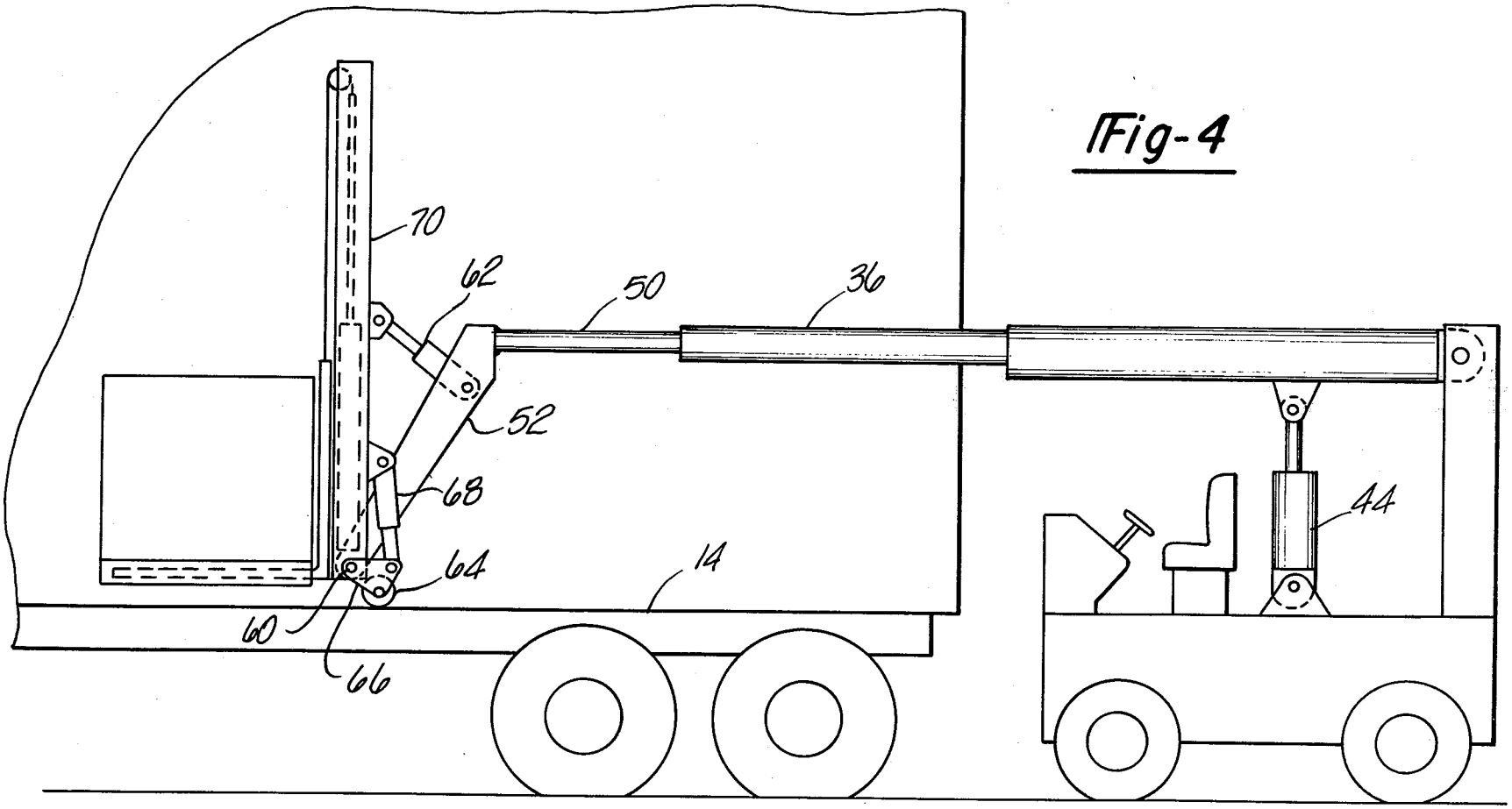
FIGS. 4 and 5 are additional views of the FIG. 3 system, showing components at different positions during a cargo-transfer operation.
Figure 5:
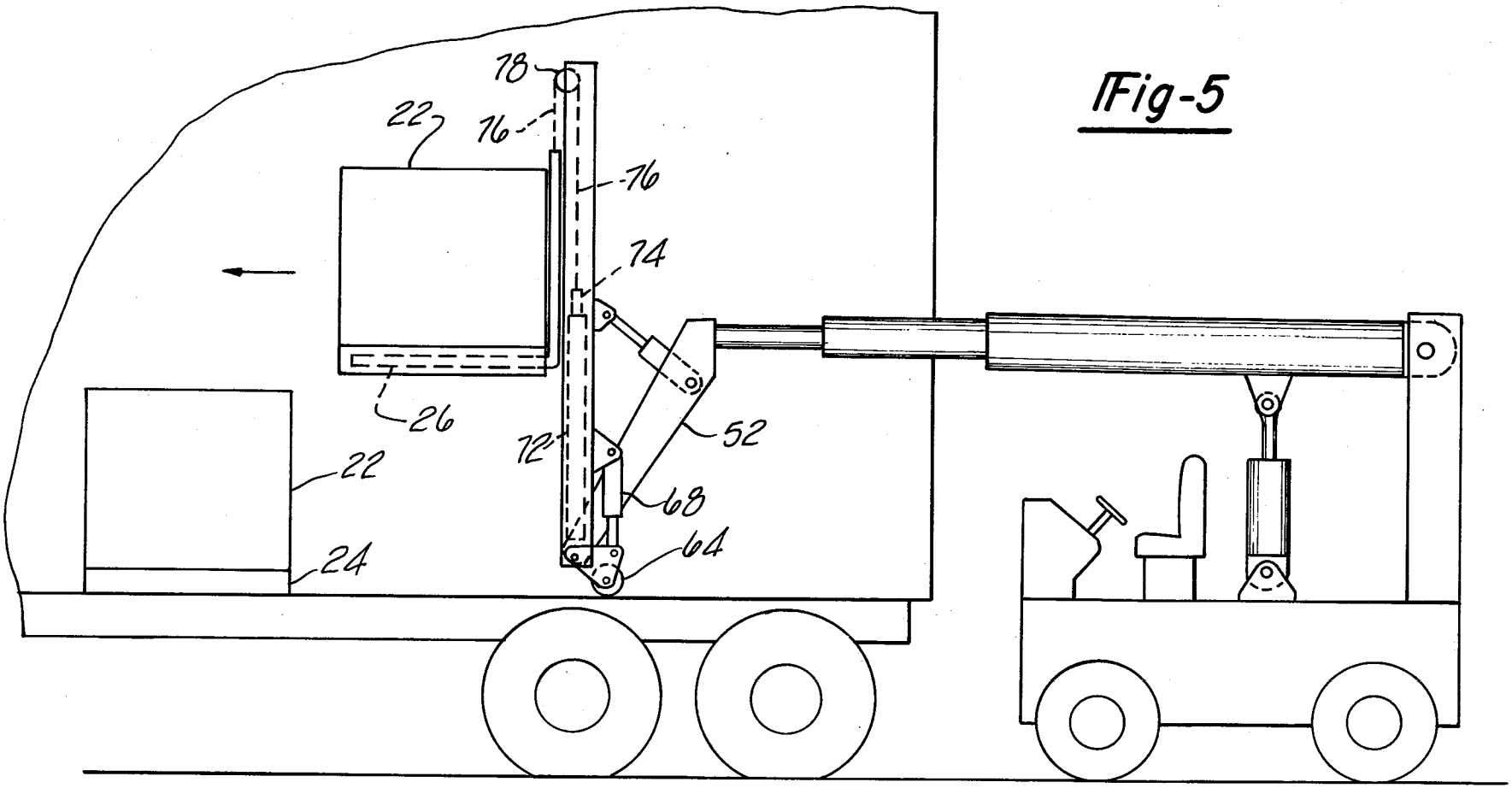

The structural arrangement of FIG. 1 represents a preferred embodiment of this invention. However other variations may be devised to also utilize this invention. For example, FIGS. 3, 4 and 5 illustrate a variation wherein the lift mechanism 33 is mounted for vertical sliding motion on a mast 70 that is pivotally joined at its lower end to the arm 52 via the aforementioned pivot shaft 60. Disposed within mast 70 is a hydraulic cylinder 72 having a piston rod 74 whose upper end is connected to a chain or cable 76 trained around a sprocket or pulley 78 journaled in the upper end of mast 70.

FIG. 3 shows the cargo-transfer system in condition for depositing cargo on floor 14. FIG. 4 illustrates the same system after introduction of pressurized liquid into cylinders 68, such that the cargo is raised from floor 14. FIG. 5 illustrates the same mechanism at a stage wherein a second cargo component is being shifted forwardly toward the space above an already-deposited cargo item. General operation of the FIG. 3 system is believed apparant from the previous description.

Figure 6:
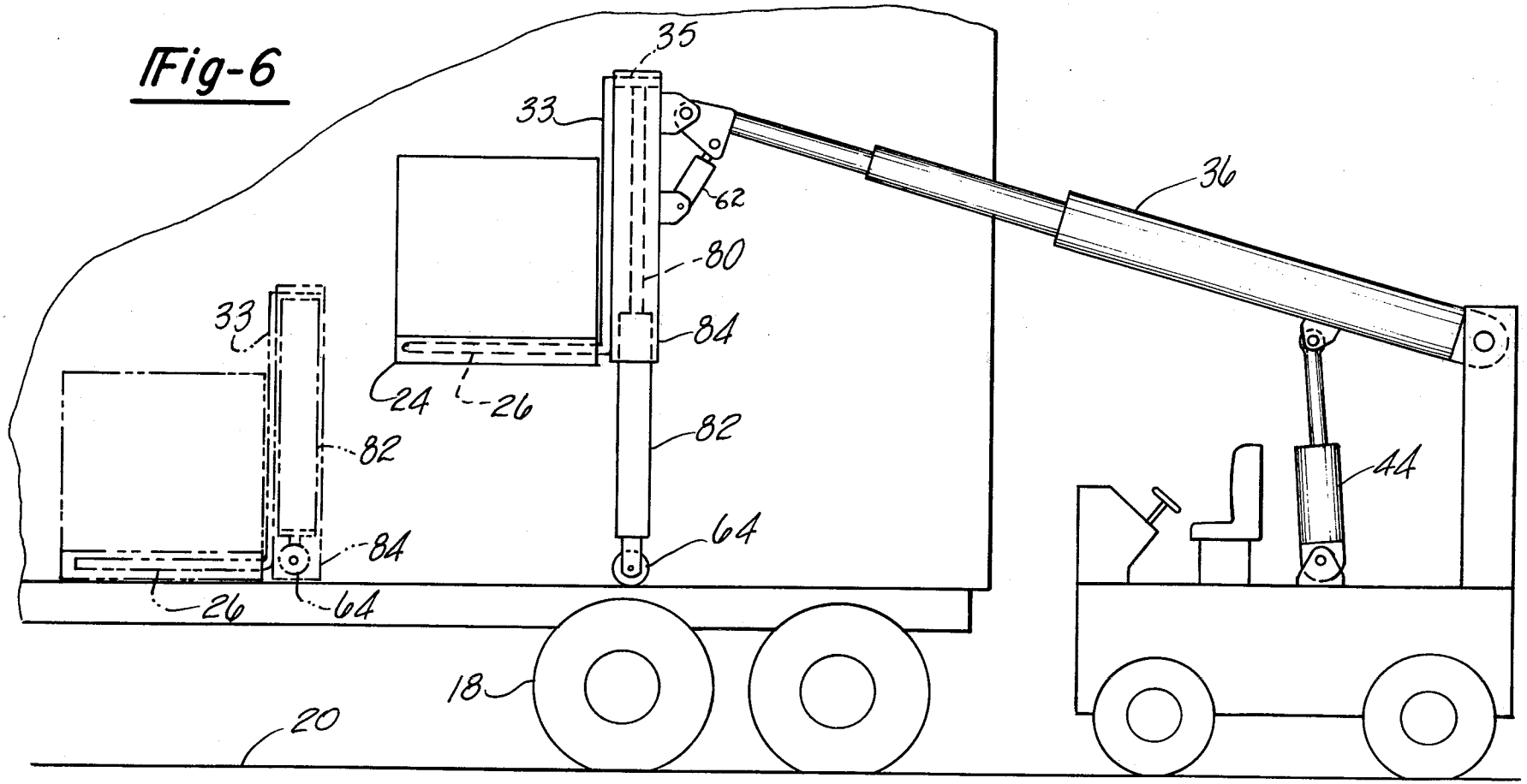
FIGS. 6, 7 and 8 are side elevational views of three other systems embodying my invention.

FIG. 6 illustrates a variant of this invention wherein the lift mechanism 33 is provided with a rearwardly extending flange 35 that is connected to the piston rod 80 of a hydraulic cylinder 82; one or more rollers 64 are suitably mounted on the lower end of cylinder 82 to be contained within a housing 84 when cylinder 82 is depressurized to the dash line position. Housing 84 is rigidly connected to lift mechanism 33 so that when cylinder 82 is depressurized the forks 26 will be released from the pallet 24. Cyliner 82 performs the two functions of the individual cylinders 68 and 72 in the FIG. 3 embodiment. General operation of the two systems is the same.

Figure 7:
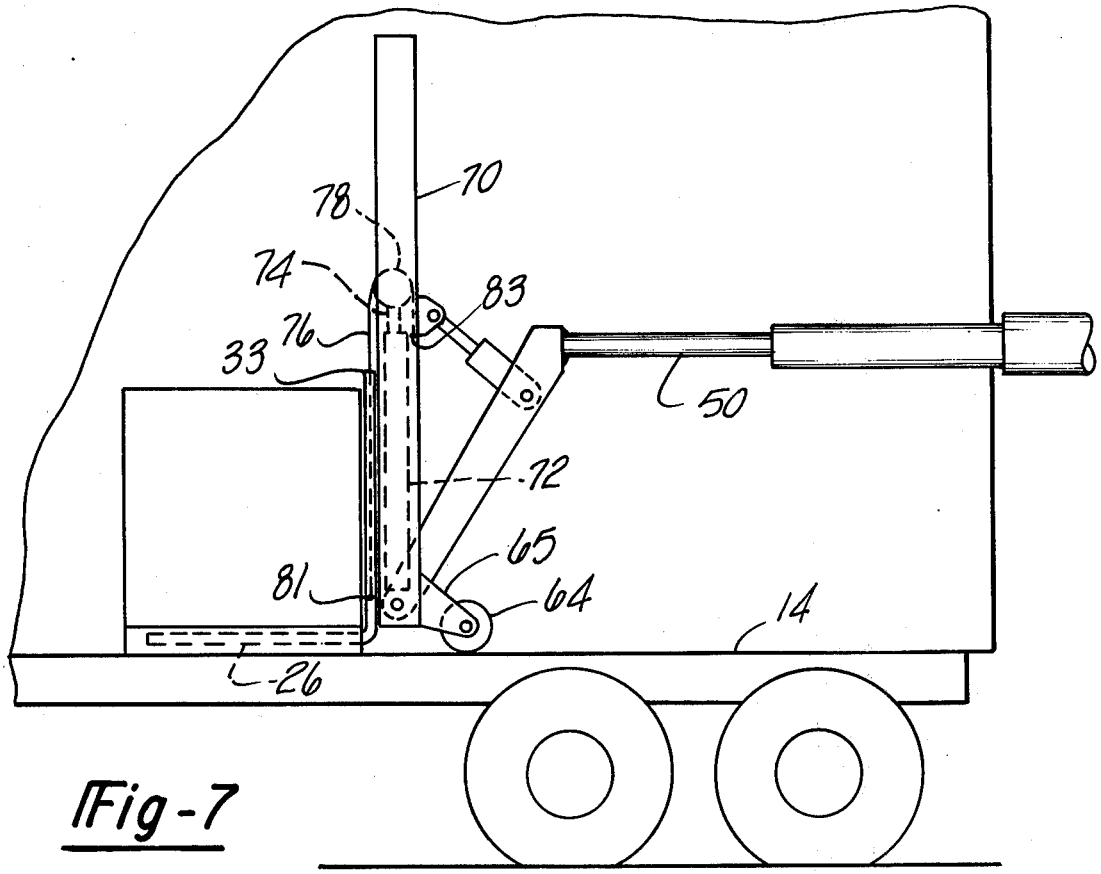

FIG. 7 illustrates a variant which is similar to the FIG. 3 system in that lift mechanism 33 is adapted to move vertically on a mast 70. However, in the FIG. 7 system the lower end of the mast is spaced above forks 26 when said forks are in their extreme lowered positions. In this case the rollers 64 are attached rigidly to the mast 70 via brackets 65. Cargo is raised from floor 14 by introduction of pressurized liquid into the upper end of a hydraulic cylinder 72 mounted rigidly in the mast 70. Piston rod 74 carries a sprocket or pulley 78 which engages a chain or cable 76 having anchorage points 81 and 83 on the lift mechanism and hydraulic cylinder 72, respectively. Upward motion of piston rod 74 produces a lifting action a mechanism 33.

Figure 8:
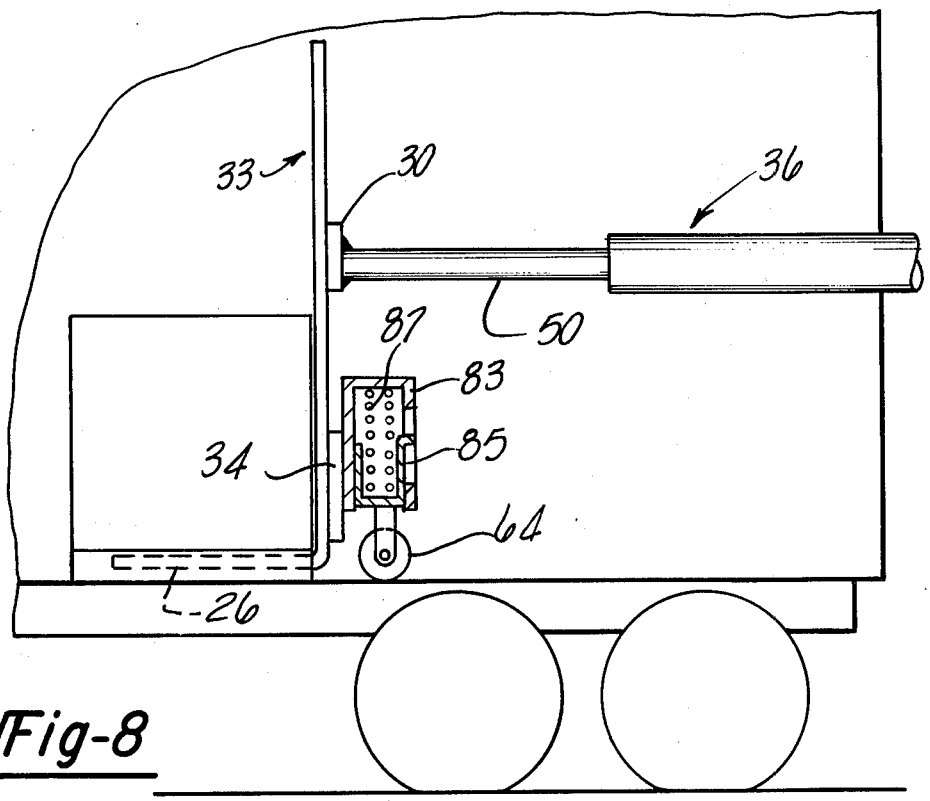

The system shown in FIG. 8 represents what might be considered a minimum system for relieving at least part of the cargo weight from the boom 36. In this less-preferred system the lift mechanism 33 includes an upper bar 30 welded to piston rod 50 and a lower bar 34 that serves as a mounting means for two vertical tubes 83, only one of which is shown in FIG. 8. Contained within each tube 83 is a smaller tube 85 that carries a floor-contacting roller 64. Compression coil spring 87 provides a downward force on roller 64 and an upward force on lift mechanism 33. Assuming that the spring force is the same as the weight of the cargo to be lifted plus the weight of boom 36, then the cargo weight will be completely counterbalanced by the spring. Upward or downward movement of the lift mechanism and its cargo can then be accomplished by controlling the pressure within the aforementioned hydraulic cylinder 44 (see FIG. 1). The FIG. 8 system permits boom 36 to be extended or retracted in the direction of its length with the cargo slightly elevated from floor 14, so that rollers 64 relieve the load on the outboard end of the boom.

Figure 9:
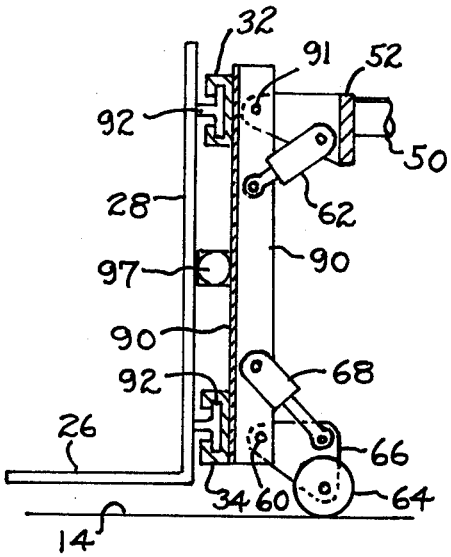
FIG. 9 is a sectional view on line 9—9 in FIG. 10, fragmentarily illustrating another embodiment of the invention.
Figure 10:
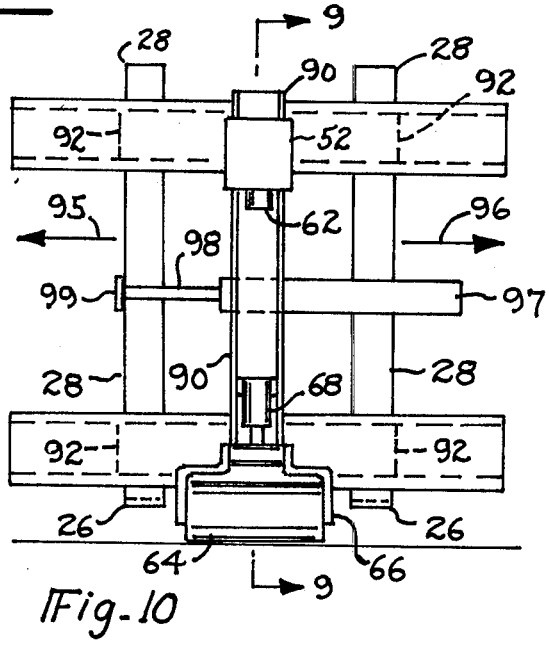
FIG. 10 is a right end view of the structure depicted in FIG. 9.

During use of the above-described cargo-transfer systems some care must be exercised by the operator of truck 40 in order that forks 26 will be properly inserted into the slots or spaces within pallet 40. In some situations the truck operator is located twenty or more feet from the selected pallet so that truck-pallet alignment operations (prior to insertion of the boom into the cargo area) require operator skill or experience. FIGS. 9 and 10 illustrate an embodiment of the invention wherein the lift forks 26 are mounted for sidewise adjustment on the carriage; this adjustment enables the truck operator to shift the forks sidewise after the forks are in close proximity to the pallet at the remote end of the cargo storage area. The advantage is less operator skill requirement, less preliminary shifting movement of truck 40, and quicker more predictable insertion of the forks into the pallets.

As shown in FIGS. 9 and 10, the lift mechanism includes a channel cross-sectioned carriage element 90 having a pivotal connection 91 with arm structure 52 carried by piston rod 50. A single lowerable roller 64 is carried on support arm 66 that is pivotably connected at 60 with the lower end of carriage 90. A single hydraulic cylinder 68 provides the motive force for raising or lowering carriage 90 relative to floor surface 14.

The upstanding rail sections 28 of liftforks 26 are secured to upper and lower T-shaped slide elements 92 that slidably fit within channel-shaped guide bars 32 and 34 suitably secured to carriage 90. This arrangement enables the liftfork assembly to be shifted sidewise as a unit in the directions indicated by arrows 95 and 96. FIG. 10 shows the liftfork assembly in a centered position. Motive power for shifting the forklift assembly is provided by a hydraulic power cylinder means that includes a cylinder means that includes a cylinder 97 suitably affixed to carriage 90, and a piston rod 98 affixed to a bracket 99 extending rearwardly from one of the liftfork rails 28. Introduction of pressurized liquid into the right end of cylinder 97 produces a leftward movement of the forklift assembly from the centered position of FIG. 10; introduction of pressurized liquid into the left end of cylinder 97 produces a rightward movement of the forklift assembly. Operation of the necessary liquid control valves is preferably accomplished from the driver station in truck 40.

As previously indicated, my invention is directed toward the use of raisable-lowerable roller means 64 for relieving load on boom 36 when it is operating in its extended mode. The drawings show various ways in which rollers 64 can be connected or attached to the cargo lift mechanism 33 for relieving undesired vertical force moments on the extensible-retractible boom 36. Other ways for mounting the rollers 64 can be visualized. I wish it to be understood that I do not desire to be limited to the exact details of construction shown and described for obvious modifications will occur to a person skilled in the art.

I claim:

1. In a cargo-transfer system comprising a storage space defined partly by a floor; a truck movable toward or away from the storage space; a boom mounted in cantilever fashion on the truck so that movement of the truck toward the storage space causes the boom to advance into the space; means for extending or retracting the boom in the direction of its length, whereby the free end of the boom can be moved back and forth within the storage space without relocating the truck; cargo-lifter mechanism carried by the free end of the boom; means supporting the boom on the truck for swinging movements in a vertical plane; and power means (44) trained between the truck and boom for swinging the boom vertically, whereby the lifter mechanism is enabled to deposit or remove cargo at various selected locations on the floor of the storage space; said cargo lifter mechanism comprising an upstanding rail structure (28) and a set of horizontally-extending forks (26) adapted to underlie a cargo pallet resting on the floor of the storage space:

the improvement comprising floor-engageable roller means carried by the cargo-lifter mechanism for substantially reducing gravitational loadings on the boom power means while cargo is being moved toward or away from its selected location on the floor of the storage space; support structure for the roller means comprising a downwardly-swingable arm means (66) pivotally connected to the aforementioned rail structure at a point near the rail structure lower end; the roller means being connected to the free end of the arm means for movement from an elevated position above the lower surfaces of the forks to a lowered position below the lower surfaces of the forks; and fluid power cylinder means (68) trained between the rail structure and the swingable arm means for moving the roller means between the elevated and lowered positions.

2. The improvement of claim 1 said roller means consisting of two laterally-spaced rollers, each having a diameter of approximately five inches; said downwardly-swingable arm means consisting of individual support arms for the individual rollers, each support arm being approximately six inches in length measured from the arm swing axis to the roller axis; the aforementioned fluid power cylinder means having a stroke such that the support arms travel through an arc of approximately thirty degrees to move the rollers from their elevated positions to their lowered positions.

* * * * *